United States Patent [19]

Arthur et al.

[11] 4,133,277

[45] Jan. 9, 1979

[54] STOCKING TOE END CLOSING APPARATUS

[75] Inventors: Ronald L. Arthur; Buddie A. Rankin, both of Charlotte, N.C.

[73] Assignee: Speizman Industries, Inc., Charlotte, N.C.

[21] Appl. No.: 826,746

[22] Filed: Aug. 22, 1977

[51] Int. Cl.[2] ..... D05B 21/00

[52] U.S. Cl. ..... 112/121.15

[58] Field of Search ..... 112/121.15, 121.11, 112/121.12, 121.29, DIG. 2, 153; 223/43, 112

[56] References Cited

U.S. PATENT DOCUMENTS

| | | | |
|---|---|---|---|
| 3,738,294 | 6/1973 | Christiansen | 112/121.15 |
| 3,859,938 | 1/1975 | Fukuyama | 112/121.15 |
| 3,941,069 | 3/1976 | Fukuyama | 112/121.15 X |

*Primary Examiner*—H. Hampton Hunter

*Attorney, Agent, or Firm*—Richards, Shefte & Pinckney

[57] ABSTRACT

Stocking toe end closing apparatus of the type having a series of horizontal stocking turning tubes mounted on a rotatable base for indexing to a position for spreading stocking toe ends carried on the supports, and for further indexing to a seaming position where the stocking toe ends are closed. Spreading fingers with stocking-penetrating needles in their ends are inserted longitudinally into the open free ends of the supported stockings at the spreading position and expand through longitudinal slots in the tubes for lateral spreading of the stocking toe ends to a width suitable for seaming, and the fingers are then moved away from the support end first in a longitudinal direction and then in a diagonal direction with respect to the elongation of the tubes in synchronism with the index motion of the tube, so that the stocking toe end is carried by the fingers to a position where the fingers and the toe end extremity lie beyond an arcuate clamp which then engages and clamps the widespread toe end while it is held by the needled finger ends. The fingers are next contracted to release the toe end and are then removed longitudinally from the toe end, which is held in position for rotation of the clamp and the toe end extremity past a sewing machine for closing. Suction from the same suction source that provides suction for everting stockings is applied underneath a perforated suction plate adjacent the clamp for sucking and holding down the toe end extremity (and any loose ends thereof) away from the clamp for guidance and direction into the sewing machine and to hold it clear of the fingers during their return diagonal movement for subsequent insertion into another open toe end. The fingers are longitudinally returned from their longitudinal removal position prior to spreading another open toe end.

18 Claims, 5 Drawing Figures

STOCKING TOE END CLOSING APPARATUS

BACKGROUND OF THE INVENTION

The present invention relates to apparatus for closing the toe ends of stockings, and more particularly to apparatus that automatically supports and transfers stocking toe ends to and through a toe end seaming operation.

Many attempts have been made to provide apparatus useful for stocking toe closing without satisfactory success. A typical example of such prior art apparatus is that shown in U.S. Pat. No. 3,738,294, which discloses indexing turning tubes on which stockings are supported for manual spreading and positioning of stocking toe ends from the turning tubes onto a thin flat carrier that moves the spread toe end into a clamp that clamps both the spread toe end and the carrier and from which the carrier is withdrawn, leaving the spread toe end in the clamp with its extremity outside the clamp for feeding through an adjacent sewing machine upon rotation of the clamp. In other forms of prior art apparatus of this type the turning tubes or other supports for stockings are advanced directly into clamps, which clamp both the stocking and support and from which the support is withdrawn while the clamp retains the stocking in as accurate a position as possible for seaming. An example of the latter type of apparatus is disclosed in U.S. Pat. No. 3,941,069, which discloses spreading elements within the stocking support member and operable to expand and spread a supported stocking toe end for clamping.

In all of the prior apparatus that mechanically positions the stocking toe ends in clamps rather than this being done manually, the apparatus requires positioning of the carrier, spreading means or end of the stocking support within the clamp and it is necessary to withdraw the carrier, spreader or support end from the clamp while leaving the stocking toe end in place. This provides problems of mechanical construction and operation, difficulty in controlling and maintaining control of the position of the stocking toe end when the carrier, spreader or support end is removed from the clamp. Further, these types of prior apparatus require either manual spreading of the stocking toe ends or a complicated spreading mechanism incorporated in the stocking tube or support.

A different type of toe end closing apparatus which overcomes the objections to the just previously explained prior art apparatus is disclosed in Italian Pat. Nos. 9356-A/76 and 9498-A/76 and the corresponding U.S. patent application Ser. No. 769,654. The apparatus disclosed in these patents provides a relatively simple means of spreading the toe end and locating it suitably in the clamp, advantageously the spreading means is not clamped within the toe end and the possibility of poor positioning of the toe end and damage thereto is thereby eliminated, and once the operator has positioned the toe end suitably on the stocking support, the whole operation is automatic, resulting in significant labor savings. However, there are certain operational difficulties encountered with the apparatus disclosed in these patents and patent application, such as:

(a) a difficulty in continually achieving the proper relation of the "run guard" (which is a band of run-resistant knitting adjacent the toe end of a stocking) with the clamp, since the run guards may vary in distance from the toe end extremity with different styles of stockings. Previously, an attempt was made to position the toe end extremity at some different relation to the end of the stocking support for each stocking style so that the run guard would always be in the same relation to the stocking support and therefore to the spreading means which was always in constant lengthwise relation to the stocking support at the time of spreading and to the clamping means at the time of seaming. This is an unsatisfactory process, due to human error in estimating the position of the toe end extremity relative to the end of the stocking support and in remembering the position for each style.

(b) a difficulty in moving the relatively large contracted spreading means into the relatively small open toe end on the stocking support in a direction diagonal to the stocking support, which means that the operator must be especially careful to position the toe end without scallops, folds, or irregularities overhanging the support end or protruding into the hollow support through the slots therein for accommodation of the expanding of the spreading means, lest the spreading means catches on some portion of the toe end and consequently fails to enter suitably therein.

(c) loose ends of knitting yarn frequently occur at the toe ends, are blown away from the arcuate clamp toward the spreading means by the stream of air directed onto the extremities of the clamped toe ends to extend them and direct them into the seaming means, and are prone to become and remain looped over the extending ends of the spreading means after the toe end has been clamped and the spreading means has been contracted to release the toe end, thereby causing troublesome entanglements when the spreading means is returned to a position for insertion in a subsequent toe end supported on a stocking support.

(d) the tips of the spreading means or fingers are relatively smooth to facilitate disengagement from the toe ends and any loose strands of knitting yarn as previously mentioned, and thereby have a less positive than desirable engagement with the toe end, especially since the spreading means must pull the stocking leg longitudinally from the stocking supports in the process of positioning the spread toe end in the clamp, and must hold the stocking widespread in its original relation to the spreading means until clamped, without slipping thereon. Clamping tends to pull the toe end down over and off one or both of the spreading tips with resulting occasional failures to properly close toe ends; therefore, subsequent to the invention disclosed in the aforementioned Italian patents, extending needles were added at the engaging tips of the spreading means to penetrate and positively engage the toe ends to ensure their retention on the spreading means until suitably clamped. However, these needles created a new problem in that when the spreading fingers were contracted to release the toe end, the release was not always complete, the fingers then being likely to disturb the relation of the toe end to the clamping means as the fingers were returned diagonally for insertion in another toe end though still engaged with the clamped toe end.

The toe end closing apparatus of the present invention overcomes these operational difficulties by providing a movement (adjustable in extent to accommodate run guard position changes, or other style changes) longitudinal of the stocking support for insertion of the contracted spreading means into the open toe end, longitudinal removal movement of the spreading means to better release the toe end after it has been clamped and the spreading means has been contracted for its release, and a suction plate adjacent the clamp for holding the released toe end extremity (and loose yarn thereof) extended away from the arcuate clamping means, directing and guiding it into the seaming means, and holding it down and out of the way of the spreading means to provide clearance for the return movement of the spreading means.

These novel improvements to the apparatus result in less skill, patience and effort being required of the operator, and the automatic operations of the apparatus are made more certain and foolproof, again with less requirement for the attention, skill and effort of the operator in overcoming apparatus misfunctions in order to maintain economical production.

SUMMARY OF THE INVENTION

Briefly described, the present invention provides an improvement in a stocking toe end closing apparatus of the type having seaming means; means for clamping a toe end located for moving it past the seaming means; elongated support means for supporting a stocking with an open toe end at a spreading position; movable expandable spreading means for insertion into the open toe end carried on the support at the spreading position for expansion thereafter to support and spread the toe end laterally to a flat widespread width suitable for seaming; transfer means for causing movements of the spreading means, in relation to the support means and the clamping means, into the toe end of a supported stocking from its toe end, to a position adjacent the seaming means to locate the supported spread toe end to be clamped with its extremity outside the clamp for seaming, and for return for a subsequent insertion movement; and means for expanding the spreading means after the insertion movement into a toe end and for contracting the spreading means to release the toe end after it is clamped.

The improvement provides longitudinal insertion and removal of the spreading means into and away from the open toe end, the latter action occurring after the spread toe end has been clamped for seaming and essentially before the return movement of the spreading means. The spreading means is also longitudinally reversibly movable both from the spreading position after the insertion and spreading and from its longitudinal removal from the toe end before its subsequent expansion at the spreading position in another toe end. A shifting means is included in the transfer means to cause the insertion and removal movements (and their reverse movements) to be longitudinal.

Preferably, the shifting means is formed by slide means mounted on the transfer means for carrying the spreading means, and the longitudinal movements are supplemental to the spreading means movement for locating the toe end in the clamping means and its return movement for the subsequent insertion movement, and means is provided for causing the supplemental movements in suitable sequence. For clamping, the spread toe end extremity and the spreading means are located beyond the clamping means.

In the preferred embodiment of the invention, actuators cause reciprocal movement between the slide means and the transfer means in suitable sequence as determined by control means therefor operating in timed relationship with the transfer means, and the adjusting means for the longitudinal insertion movement is formed by a stop of selective length for limiting the insertion extent of the reciprocal movement caused by the actuator therefor.

In the preferred embodiment, a perforated suction plate is located adjacent the clamping means and underneath the toe end extremity as it extends beyond the clamping means when the toe end is clamped for seaming. The suction plate directs air currents which hold the toe end extremity down and away from the clamping means for direction and guidance into the seaming means.

DESCRIPTION OF THE PREFERRED EMBODIMENT

Figure 1:
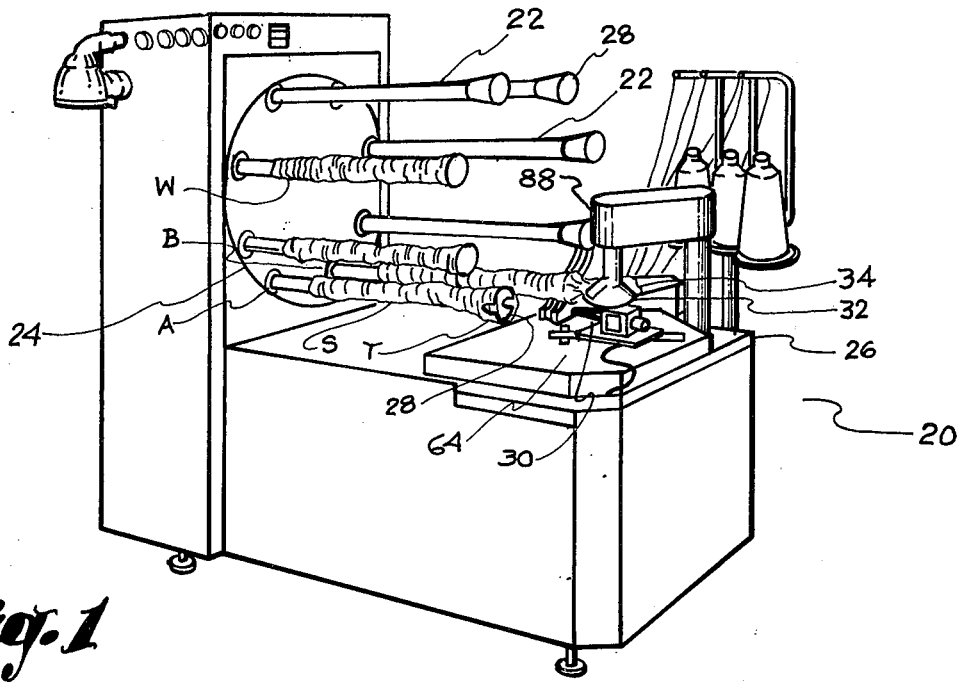
FIG. 1 is a perspective view showing the general relation of the principal elements of an automatic stocking toe end closing apparatus which incorporates the preferred embodiment of the improvements of the present invention.

In the illustrated preferred embodiment as shown in FIG. 1, a stocking toe end closing apparatus 20 is shown with stocking support tubes 22 mounted on an indexable stocking support base 24 which is mounted for rotary indexing on a machine frame 26 with the hollow free ends 28 of the supports 22 arranged to index to a spreading position where spreading means 30 can be inserted therein for spreading and moving a stocking toe end into a clamping means 32 for clamping and subsequent movement past toe end seaming or closing means 34.

In the illustrated embodiment, typical knit stockings S are shown in FIG. 1 to indicate the manner in which they are drawn onto and supported by the stocking support means 22. In this embodiment eight elongated support tubes 22 are mounted on the circular rotatable support base 24 for indexing in a direction transverse to their elongations. Base 24 has associated ratchet and pawl means (not shown) for sequentially indexing the tubes 22 to and away from positions for supporting stockings for spreading and seaming; the support tubes 22 will always be disposed at the positions or stations indicated as A and B except during the actual indexing motion of the base 24. The station designated as A is the spreading station, and B is the seaming station. Typically of the art, the support tubes 22 have tubular bores connected to a source of suction (not shown) at certain of the index stations other than stations A and B for everting and controlling stockings at those stations.

As is well known in the art, the operator of this machine must perform certain manipulations on the stockings S as a preliminary to the fully automatic subsequent operations, and these manipulations are performed as follows First, the operator obtains a knit stocking S from a handy supply of stockings which are turned right-side-out; then the operator presents the open toe end T to the hollow free end 28 of a support tube 22 as it is indexing toward or located at a station prior to station A, and the operator allows the stocking to be drawn toe end first into the bore of the tube 22 by the flow of air into the bore under the influence of the suction connected thereto. When the operator has allowed most of the stocking S to disappear into the bore of the tube 22, but still retains control of the stocking S by holding the welt end W, the operator then draws the welt end W over the tube 22 toward the support base 24 until the stocking S assumes the position as shown at station A in FIG. 51, with the open stocking toe end extremity X located essentially coincident with the extremity of the hollow free end 28 of the tube 22, turning the stocking inside-out in the process.

It is desirable that the extremity X of the toe end T should always lie accurately at the extremity of the hollow free end 28; and while a skilled operator may achieve this relation in initially drawing the stocking S over the support means 22 at the second station before station A, the support tube 22 with the stocking S thereon then indexes to the station next before station A where the operator may make a final manual adjustment to the position of the extremity X to achieve the desired relation with the extremity of the hollow free end 28 if not achieved initially. Thus, the stocking S is indexed to station A, the spreading position, supported on a tube 22 with its extremity X in exact position for performance of the automatic operations to be described hereafter. One of the advantages of the present invention is that this position is always the same, regardless of the style of stocking toe end, rather than requiring different relations of the extremity X and the free end 28 depending on the stocking toe end style, as explained hereinafter.

The present invention is concerned with the following automatic operations to be performed on a stocking S: spreading the toe end T of the stocking S; moving the widespread toe end T between the shaped clamping means 32 and clamping the toe end T therebetween with the toe end extremity X hanging outside the clamping means 32; and moving the clamping means 32 past the toe end closing means 34 for closing the toe end T. The details of the preferred embodiment for improving the accomplishment of these automatic operations are fully described hereafter.

Figure 2:
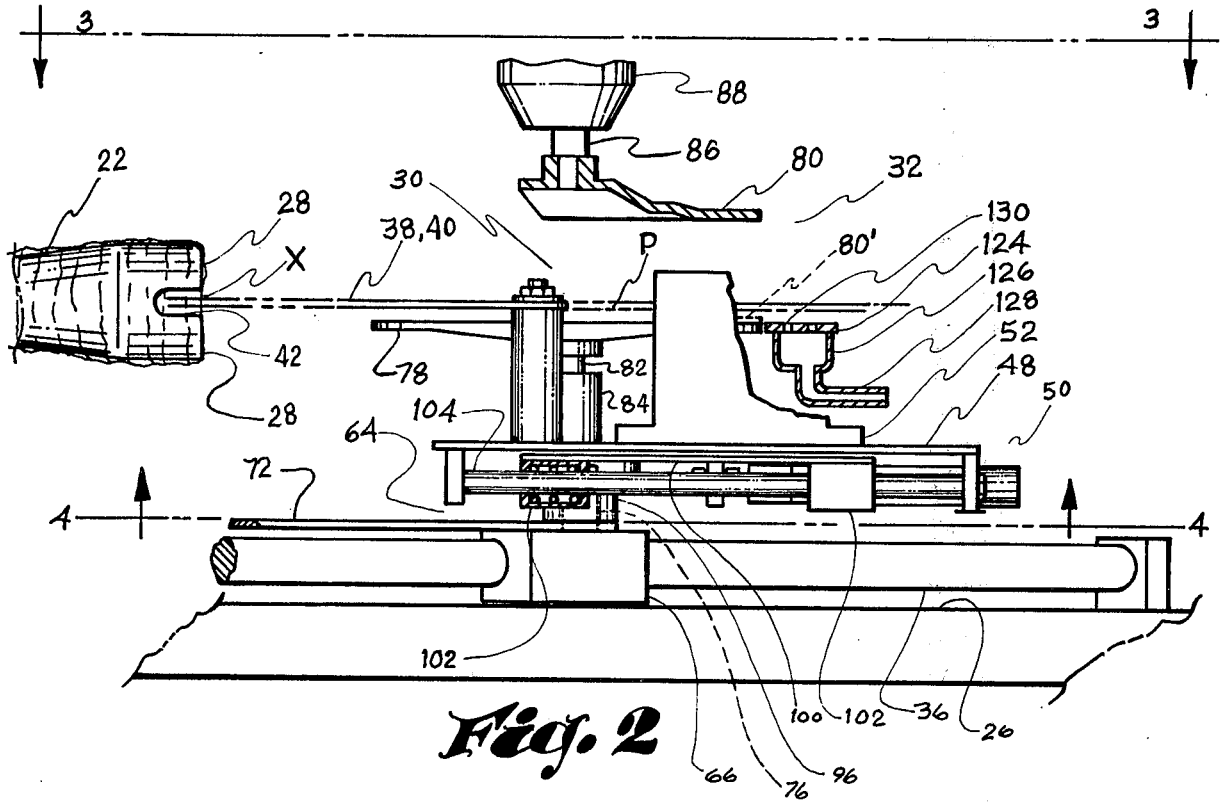
FIG. 2 is a partial left-side elevational view of the stocking toe end closing apparatus of FIG. 1 showing the portion of the apparatus where the present invention is incorporated.
Figure 5:
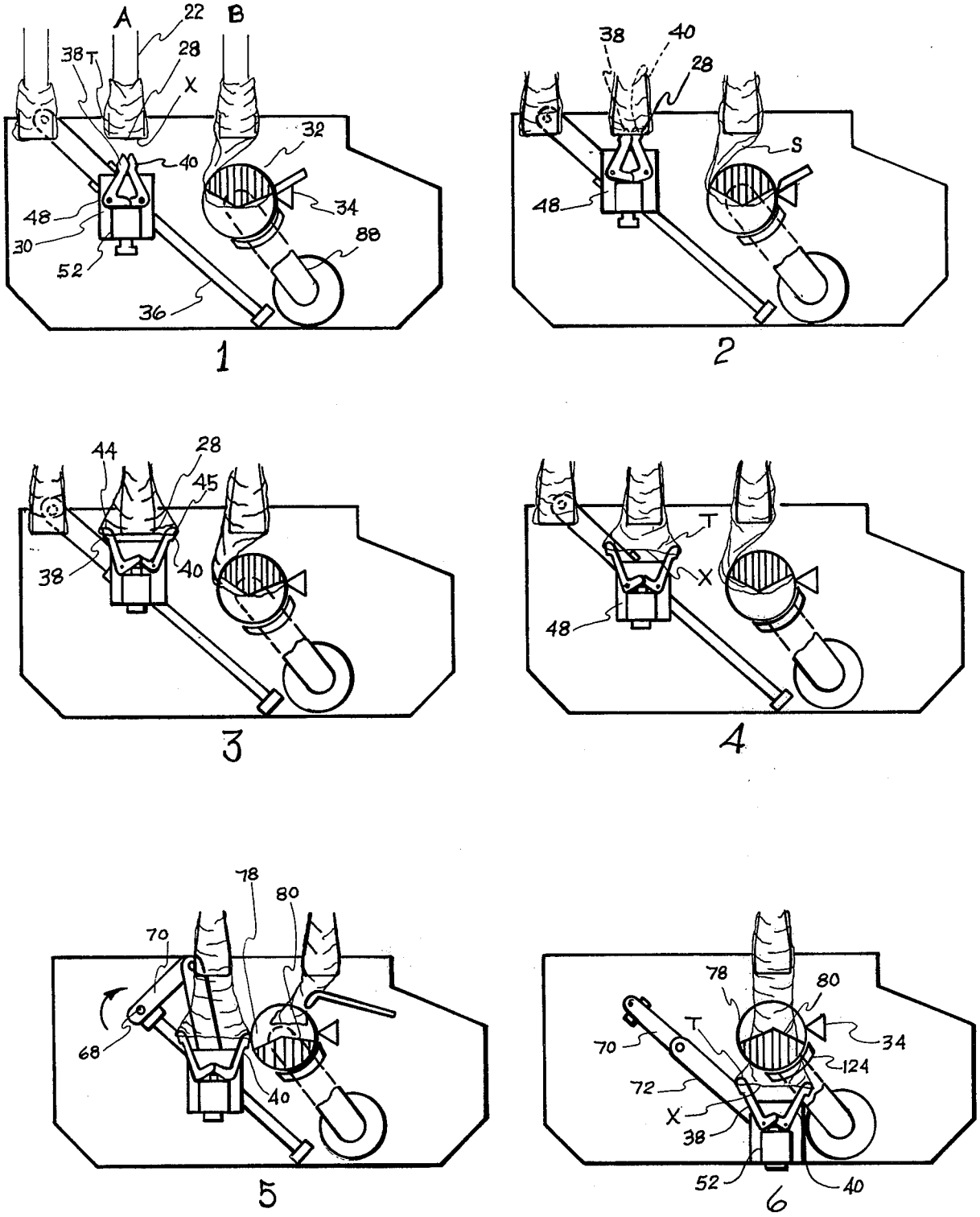
FIG. 5 is a schematic representation of the same view as FIG. 3, showing in panels 1–10 the sequence of movements of various elements of the present invention.
Figure 5:
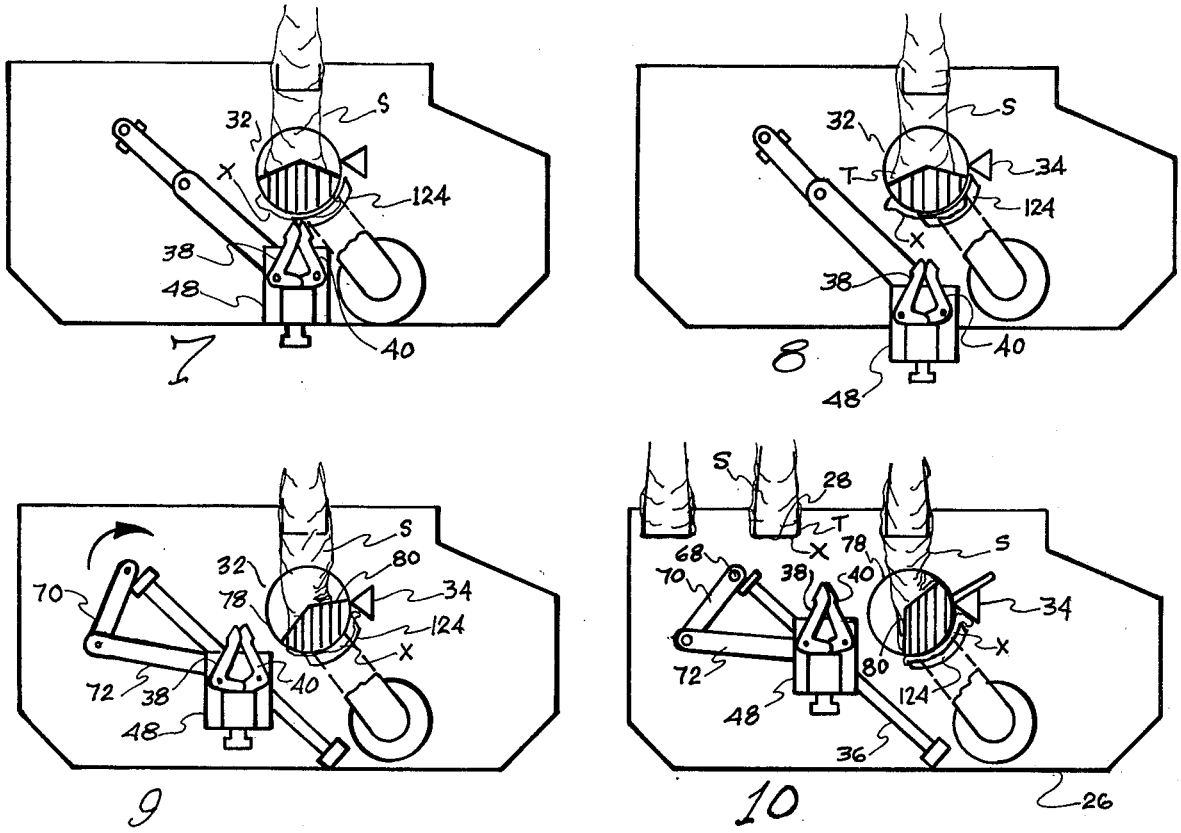

As best shown in FIG. 5-1, a movable stocking toe end spreading means 30 is mounted on a slide rod 36 for movement in a direction diagonal to an elongated support tube 22 for movement of the toe end T, after spreading, for locating the spread toe end T for closing by seaming. The spreading means 30 includes an opposed pair of spreading fingers 38 and 40 arranged for horizontal scissors action for contraction to a closed position as shown in FIG. 5-1 for insertion within the hollow free end 28 of the tube 22 from the free end 28 thereof. As shown in FIG. 2, recesses in the form of longitudinal slots 42 are provided in the hollow free ends 28 of the tubes 22 so that the toe end spreading fingers 38, 40 may be expanded laterally from their inserted, contracted position within end 28 as shown in FIG. 5-2 to their spread or expanded position as shown in FIG. 5-3, on the exterior of the hollow end 28, their spreader tips or engaging ends 44, 45 having passed laterally freely through the slots 42.

Figure 3:
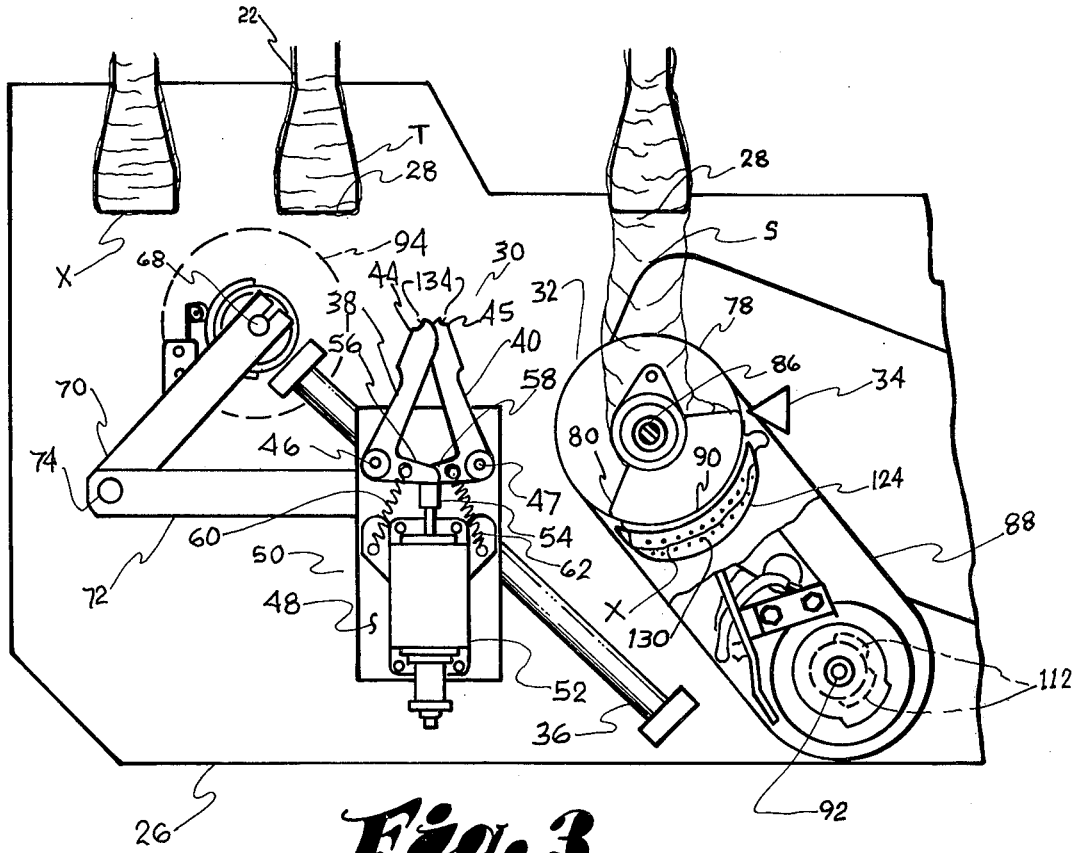
FIG. 3 is a partial plan view taken along the line 3—3 of FIG. 2 and showing the portion of the apparatus incorporating the improvements of the present invention.

Since the operator has previously positioned the toe end T over the hollow end 28 with the toe end extremity X aligned with the extremity of the hollow end 28 prior to the insertion therein of the contracted spreading means 30, the stocking toe end T is engaged, supported, and held widespread laterally to a flat width suitable for seaming by the spreading fingers 38, 40 as shown in FIG. 5-3.

Figure 4:
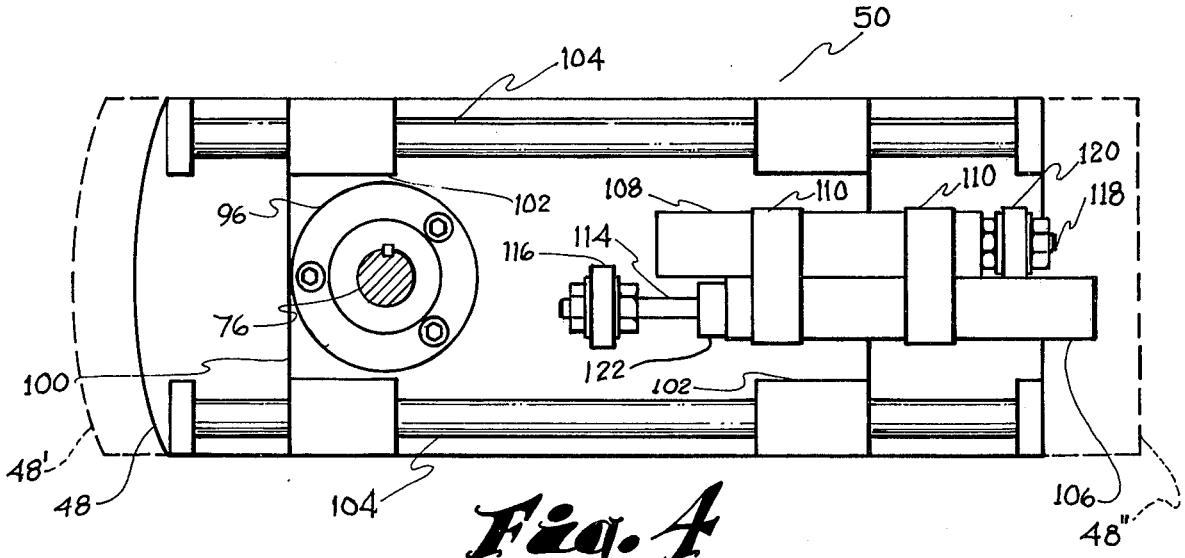
FIG. 4 is an enlarged view of the shifting means taken along the line 4—4 of FIG. 2.

As shown in more detail in FIG. 3, the spreading fingers 38, 40 are pivoted for spreading on pins 46, 47 fixed in a slide plate 48 forming part of shifting means 50, which is best shown in FIG. 4. The spreading fingers 38, 40 are spread by the action of a solenoid device 52 mounted on the slide plate 48 and having a movable plunger 54 bearing against the lever arms 56, 58 of the spreading fingers 38, 40, respectively. Springs 60, 62, stretched between lever arms 56, 58 and pins mounted in the slide plate 48, act to return the spreading fingers 38, 40 to their contracted position when the solenoid 52 is de-energized.

Transfer means 64 for sequentially moving the shifting means 50 as shown in FIG. 2, and the spreading means 30 mounted thereon, is provided by the slide rod 36 mounted on the frame 26 and journalled in the slide block 66 for continuing reciprocation of the slide block 66 along the slide rod 36 sequentially between its position for insertion of spreading means 30 as shown in FIG. 5-1, its transferred position for locating the toe end T for clamping and seaming adjacent the seaming means 34 as shown in FIG. 5-6, and its return to insertion position. The reciprocation is accomplished by constant speed rotation of a shaft 68 carrying a crank arm 70, by means of a connecting rod 72 which is pivoted at one end on a pin 74 at the outer end of the crank arm 70 and at its other end on a wrist pin 76 fixed in the slide block 66.

As shown in FIG. 5-1, slide rod 36 is positioned diagonally with respect to the elongation of the support tubes 22 for guiding the slide block 66 along the same diagonal path for both location for seaming and return for insertion movements, and a synchronized drive (not shown) is provided within the apparatus 20 for timing the index motion for the stocking support base 24 with the reciprocation of the slide block 66 so that as the slide block 66 moves away from the position for insertion, with the spreading means 30 carrying the spreading toe end T, the support tube 22 at the station A is essentially simultaneously indexed, laterally of its length, to the station B, and the spreading means 30 remains essentially aligned and centered with respect to the tube 22 so that the stocking S is pulled generally axially from the tube 22 for aligned partial withdrawal therefrom and moved with the expanded spreading means to a fully transferred position, located for clamping and seaming, as shown in FIG. 5-6. FIG. 5-5 shows an intermediate stage of the transfer motion. As shown in the sequence of the transfer motion in FIGS. 5-4, 5-5, and 5-6, the expanded spreading finger 40 passes between a lower clamp disc 78 and an upper clamp foot 80 that are incorporated in the aforementioned clamping means 32. The fingers 38, 40 thus carry the expanded, widespread toe end T between, with its extremity X extending beyond, the clamp members 78 and 80; and the spreading fingers 38, 40 also lie at a position beyond and outside the clamp members 78 and 80. The clamp disc 78 and the clamp foot 80 are shown in FIG. 2 in their separated positions in solid lines, the foot 80 having been lifted from the disc 78. The disc 78 is fixed from vertical movement, but is journalled on a vertical shaft 82 in a support 84 for free rotation in a horizontal plane to follow the rotational movement of the foot 80 when clamped therewith, as shown in broken lines at 80', for moving the stocking toe end T past the closing means 34 for closing.

The clamp foot 80 is mounted on a pivot shaft 86 journalled in a bracket 88 mounted from the machine frame 26 for rotation about the center of its arcuate clamping shape 90 in a horizontal plane, as well as for sliding movement vertically. The timed sequential clamping, rotation for seaming, return motion and unclamping of the clamp foot 80 are carried out by cams and linkages driven by a cam shaft 92 also journalled in the bracket 88 and in turn connected to and driven by the crank shaft 68 of the electric motor driven gear drive 94 mounted on the machine frame 26. The apparatus for clamping the clamp means 32 and moving it past the toe end closing means 34 forms no part of the present invention, and is included in the prior art stocking toe end closing apparatus 20 as it existed before the incorporation of the improvements of the present invention. Various other cams are mounted on the cam shaft 92, some for operation of switches for controlling the operation of the solenoid 52 and other elements of the apparatus 20, as well as certain other cams to be explained hereinafter for operation of the shifting means 50.

The shifting means 50 included in the transfer means 64 connects the slide block 66 to the spreading means and provides means for causing suitable sequential shifting movements of the spreading means 30 which are supplemental to the basic diagonal reciprocal movements provided by the slide block 66 mounted on the diagonal slide rod 36 and their associated crank and connecting rod elements. The shifting means 50 comprises a mounting hub 96 which is mounted on and keyed to the wrist pin 76 projecting vertically from the slide block 66 as shown in FIG. 2. The mounting hub 96 is fastened to the underside of a mounting plate 100 and supports the plate 100 in horizontal position and at a suitable angular orientation during diagonal movement with the slide block 66. Ball bushings 102, affixed to the mounting plate 100 in aligned sliding relationship with ball bushing slide rods 104 mounted on the slide plate 48, provide slide means included in the shifting means 50 and mounted on the transfer means 64 for a sliding, shifting movement of the slide plate 48 relative to the slide block 66 in a longitudinal direction relative to the elongated support tubes 22.

A pair of fluid operated actuators or cylinders, insertion cylinder 106 and removal cylinder 108, fastened together by clamping straps 110, serve to actuate the slide plate 48 for reciprocal movement on the transfer means 64 suitable for the purposes of this invention as explained hereinafter. The cylinders 106, 108 are actuated and controlled by a conventional source of pressurized fluid (not shown) and conventional solenoid valves (not shown) and switches (not shown). The switches are operated by suitable cams 112 mounted on the lower part of cam shaft 92 as shown in FIG. 3 to provide control means for the actuators operating in timed relationship with the transfer means.

The cylinders 106, 108 are fastened together, but are not otherwise fastened to the shifting means 50 except by their piston rods. The insertion piston rod 114 is fixed to the mounting plate 100 by an ear 116 mounted thereon, and the removal piston rod 118 is attached to the slide plate 48 by a thrust ear 120. Thus, three selective positions of the slide plate 48 relative to the mounting plate 100 and the slide block 66 are available by suitable control of the extension or retraction of the respective piston rods 114 and 118. When the piston rod 114 is extended and the piston rod 118 is retracted, the slide plate 48 and the mounting plate 100 will have the basic relation as shown in solid lines in FIG. 4, this being the relation which is necessary to achieve the apparatus configuration as shown in FIG. 5-1. When the piston rod 114 is retracted against the spacer stop 122 carried thereon, and the piston rod 118 is also retracted, then slide plate 48 will be shifted to the broken line position indicated by the numeral 48', which is the position necessary for achievement of the apparatus configuration as shown in FIG. 5-2 and 5-3. When both piston rods 114, 118 are extended, the slide plate 48 assumes the position relative to mounting plate 100 as indicated by the broken line position indicated by the numeral 48'', and this is the position necessary to achieve the configuration of the apparatus as shown in FIGS. 5-8 and 5-9.

As explained in the Background of the Invention, one of the objects of the present invention is to accommodate changes in the position of the run guard relative to the toe end extremity X deriving from stocking style changes, since the extremity X is operationally desirably always manually placed exactly even with the extremity of the free end 28 of the support tube 22 located at the spreading station A. The distance from the free ends 28 to the clamping means 32 is normally fixed in the apparatus design, as is the reciprocating stroke length of the slide block 66, so the problem of locating the toe end run guard in suitable relation to the arcuate clamping shape 90 of the clamping means 32 is solved in the present invention by varying the retraction stroke of the insertion piston rod 114, thereby adjusting the extent of the reciprocal shifting insertion movement of the slide plate 48 and the spreading means 30 carried thereon for suitably relating the longitudinal insertion movement to a selected insertion depth in the toe end. As shown in FIG. 4, the extension of piston rod 114 is limited only by the characteristics of the suitably chosen insertion cylinder, but the retraction or insertion extent of the reciprocal movement caused by the actuator or cylinder is limited by the length dimension of the space stop 122 forming the adjusting means therefor, which is typically formed by a selected length of suitable plastic tube slipped over the piston rod 114. Thus, by changing the length of the spacer stop 122, the spreading means 30 may be inserted to a selected insertion depth into the free end 28 of the support tube 22 and the toe end T carried thereon so that the spreading means 30 will engage the toe end T at a position relative to the run guard thereof so that the toe end and run guard will be suitably located relative to the clamping means 32 when clamped therein for seaming or closing.

FIGS. 2 and 3 show a perforated suction plate 124, the upper surface of which is located generally in the plane of the upper surface of the lower clamp disc 78, and the suction plate 124 is arcuate in shape at its inner edge, concentric with the clamp disc 78, and located closely adjacent thereto at an angular location which places it underneath the extending extremity X of a stocking toe end T when the toe end T is clamped in the clamping means 32. The suction plate 124 is provided with an under cover 126 and a conduit connection 128 which may be connected to the same source of suction as provided in the apparatus 20 for everting stockings on the support tubes 22. The suction thereby applied to the under cover 128 draws air downwardly through the perforations 130 in the plate 124; and the downward air currents serve to hold the toe end extremity X (and any loose ends or yarn thereof) down against the plate 124 and directed away from the clamping means 32 while the extremity X is moved, directed, and guided toward the closing means 34.

As shown in FIG. 3, the extending ends of the spreading means 30, as formed by the engaging tip ends 44, 45 of the spreading fingers 38, 40, are provided with stocking penetrating elements 134 in the form of needles projecting from the tip ends 44, 45. These needles 134 positively engage the toe end T when the fingers 38, 40 are spread therein, ensuring reliable movement of the toe end T to the location for clamping by means 32, and they also ensure that the toe end T remains in the position for clamping during the clamping movement of the clamp foot 80, which in the prior art apparatus has tended to drag the toe end T off the tip ends 44, 45 with resultant inaccurate clamping of the toe end extremity for subsequent closing.

In the usual operation of the apparatus 20, the indexing of the support tubes 22 is machine paced, and the operator has suitable time allowed for feeding stockings S into the support tubes 22, for everting the stockings S, and for positioning the stocking toe end extremities X exactly at the extremities of the free ends 28 of the support tubes 22. When a stocking S is so positioned on a tube 22 which has indexed to a station A as shown in FIG. 5-1, the transfer means 64 is suitably timed so that the slide plate 48 with the spreading means 30 mounted thereon will have arrived at the position as shown, ready for insertion of the spreading means 30 into the open toe end T at station A. The slide block 66 and the mounting plate 100 will essentially dwell at this insertion position for a brief period due to the harmonic motion characteristics of the crank and slide elements. The dwell period is suitably long to allow actuation of the insertion piston rod 114 to shift the slide plate 48 toward the support tube 22 at station A longitudinally thereof for insertion of the previously contracted spreading means 30 straight onto the toe end T to the spreading position as shown in FIG. 5-2. The dwell period also permits time for actuation of the spreading means 30 by the solenoid 52 to expand the spreading fingers 38, 40 to laterally spread the toe end T to a width suitable for seaming or closing, as shown in FIG. 5-3. In the preferred embodiment of this invention, the insertion piston rod 114 is then extended to cause the slide plate 48 to reverse and return to its basic position as shown in FIG. 5-4, thereby withdrawing the toe end extremity X from the end of the support tube 22 longitudinally thereof.

This withdrawal is followed by the generally simultaneous diagonal motion of the slide block 66 and the spreading means 30 carried thereon and the lateral indexing motion of the support tube 22 from station A to station B as shown in mid-movement in FIG. 5-5 and as shown at the completion of these generally simultaneous movements at FIG. 5-6.

As shown in FIG. 5-6, the toe end T has been located at a suitable position for clamping by means 32, and the spreading means 30 dwells essentially stationary at this position, again by the harmonic motion action of the crank and slide apparatus. This dwell period is suitably long to allow the clamping motion of the upper clamp foot 80 to clamp the widespread toe end T down against the lower clamp disc 78, to permit the subsequent deactuation of the solenoid 52 and the resultant contraction of the spreading means 30 for release of the toe end T therefrom, and to permit actuation of the removal cylinder 108 to extend the removal piston rod 118, thereby shifting the slide plate 48 away from the clamped toe end T for removal of the spreading means 30 therefrom longitudinally with respect to the elongated support tubes 22. This longitudinal supplemental movement ensures that the spreading fingers 38, 40 and the stocking penetrating elements or needles 134 are completely disengaged and removed from the toe end T in preparation for the return diagonal movement of the slide block 66 and its associated elements as the dwell period ends.

As shown in FIG. 2, the clamping motion of the clamp foot 80 will position the toe end T below the return movement path P of the spreading fingers 38, 40, and subsequent contraction of the spreading means 30 as shown in FIG. 5-7 will usually free the spreading means 30 from the toe end T, but the engaging tip ends 44, 45 of the spreading fingers 38, 40 may still be in engagement with the toe end extremity X due to irregularities in the extremity X, its flimsiness, its engagement with the needles 134, or due to loose strands of knitting yarn commonly present at the toe end extremity X. Therefore, the longitudinal removal movement of the spreading means 30 is provided by the shifting means 50 to normally disengage the spreading means 30 completely from the extremity X, and the downward air currents created through the perforated suction plate 124 serve to hold the toe end extremity X, and any irregularities or appurtenances thereof, down against the suction plate 124 to facilitate their disengagement from the spreading means 30.

In the preferred embodiment of the invention, the slide plate 48 remains in its farthermost position with both piston rods 114 and 118 extended during part of the return movement as indicated by FIG. 5-9, but some point in the return movement, such as between the positions shown in FIGS. 5-9 and 5-10, the removal cylinder 108 is actuated to retract the removal piston rod 118, thereby reversing and returning the slide plate 48 to its basic position relative to the slide block 66 and the mounting plate 100 as indicated in FIG. 5-10.

An alternative control sequence might employ only the two extreme positions of slide plate 48 relative to the slide block 66, and in such case the shifting means 50 would be returned to the insertion position with both piston rods 114 and 118 extending, and the longitudinal insertion movement of the spreading means 30 would be made by retracting both piston rods 114 and 118 simultaneously. The piston rods would then remain retracted during the movement of the spreading means for location of the spread toe end T for clamping, and then after clamping and after contraction of the spreading means 30 for release of the toe end T, both piston rods 114 and 118 would be extended for shifting the spreading means 30 away from the clamping means 32 to remove the spreading means 30 from the clamped toe end T. Some adjustment in stroke length of the slide block 66 and the location of the slide rod 36 in relation to the clamping means 32 could be required to locate the expanded spreading means 30 at the proper location with respect to the clamping means 32 during the clamping dwell of the slide block 66. Another alternative embodiment might accomplish the same purpose by utilizing only one fluid cylinder with piston stroke length approximating the total stroke length of pistons 114 and 118, with the single cylinder connected between the slide plate 48 and the mounting plate 100 and suitably actuated to provide the same long insertion shift and removal shift as just described, but with less complexity of cylinders, valves, switches, and cams.

The particular embodiment disclosed in full detail herein and illustrated in the darwings has been provided for disclosure purposes only and is not intended to limit the scope of the present invention, which is to be determined by the scope of the appended claims.

We claim:

1. In a stocking toe end closing apparatus having seaming means for closing toe ends of stockings; elongated stocking support means for supporting stockings with an open toe end at a spreading position; movable expandable spreading means insertable into the open toe end of a stocking carried on the support means at the spreading position from the toe end thereof and expandable after insertion to support the open toe end and spread it laterally to a flat widespread width suitable for seaming; and transfer means for causing sequential movement of said spreading means into the toe end of a supported stocking from the toe end thereof, movement of said spreading means in relation to said support means to a position adjacent said seaming means for locating said spread toe end for seaming, and return movement of said spreading means for subsequent insertion movement thereof; the improvement wherein said transfer means causes said spreading means to be inserted into said open toe end longitudinally thereof and to be removed longitudinally therefrom after said locating said spread toe end for seaming and essentially before said return movement of said spreading means.

2. In a stocking toe end closing apparatus, the improvement according to claim 1 and characterized further in that said spreading means is longitudinally reversibly movable from said spreading position after said insertion and spreading.

3. In a stocking toe end closing apparatus, the improvement according to claim 1 and characterized further in that said spreading means is longitudinally reversibly movable from said longitudinal removal prior to subsequent expansion thereof at said spreading position.

4. In a stocking toe end closing apparatus, the improvement according to claim 3 and characterized further in that said spreading means is longitudinally reversibly movable from said spreading position after said insertion and spreading.

5. In a stocking toe end closing apparatus, the improvement according to claim 4 and characterized further in that said longitudinal reversing from said spreading position occurs essentially before said movement for locating said spread toe for seaming.

6. In a stocking toe end closing apparatus having seaming means for closing toe ends of stockings; clamping means located for clamping a stocking toe end and moving it past said seaming means for closing; elongated stocking support means for supporting a stocking with an open toe end at a spreading position; movable expandable spreading means insertable into the open toe end of a stocking carried on the support means at the spreading position and expandable after insertion to support the open toe end and spread it laterally to a flat widespread width suitable for seaming; transfer means for causing sequential insertion movement of said spreading means into the toe end of a supported stocking, movement of said spreading means in relation to said clamping means to a position for locating the supported widespread toe end in said clamping means for clamping thereby with its extremity outside thereof, and return movement of said spreading means for subsequent insertion movement thereof; and means for expanding said spreading means after said insertion movement thereof within a stocking toe end and for contracting said spreading means to release the toe end of the stocking after it is clamped by said clamping means; the improvement comprising shifting means included in said transfer means for causing said insertion movement of said spreading means to be longitudinal to said toe end.

7. In stocking toe end closing apparatus having seaming means for closing toe ends of stockings; clamping means located for clamping a stocking toe end and moving it past said seaming means for closing; elongated stocking support means for supporting a stocking with an open toe end at a spreading position; movable expandable spreading means insertable into the open toe end of a stocking carried on the support means at the spreading position and expandable after insertion to support the open toe end and spread it laterally to a flat widespread width suitable for seaming; transfer means for causing sequential insertion movement of said spreading means into the toe end of a supported stocking, movement of said spreading means in relation to said clamping means to a position for locating the supported widespread toe end in said clamping means for clamping thereby with its extremity outside thereof, and return movement of said spreading means for subsequent insertion movement thereof; and means for expanding said spreading means after said insertion movement thereof within a stocking toe end and for contracting said spreading means to release the toe end of the stocking after it is clamped by said clamping means; the improvement comprising shifting means included in said transfer means for causing a longitudinal removal movement of said spreading means from said toe end after said clamping of said toe end.

8. In a stocking toe end closing apparatus, the improvemet according to claim 6 and characterized further by said transfer means including said shifting means for also causing a longitudinal removal movement of said spreading means from said toe end after said clamping of said toe end.

9. In a stocking toe end closing apparatus, the improvement according to claim 8 and characterized further in that said shifting means comprises slide means mounted on said transfer means and carrying said spreading means for movements longitudinally of said stocking support means and supplemental to said spreading means movement for locating said toe end in said clamping means and for said return movement thereof, and means for causing said supplemental movements to occur in suitable sequence.

10. In a stocking toe end closing apparatus, the improvement according to claim 9 and characterized further in that said means for causing said supplemental movements comprises at least one actuator for causing reciprocal movement between said slide means and said transfer means and control means for said actuator operating in timed relationship with said transfer means.

11. In a stocking toe end closing apparatus, the improvement according to claim 9 and characterized further in that said means for causing said supplemental movements comprises an actuator for causing reciprocal movement between said slide means and said transfer means for causing said longitudinal insertion movement, another actuator for causing reciprocal movement between said slide means and said transfer means for causing said longitudinal removal movement, and control means for said actuators operating in timed relationship with said transfer means.

12. In a stocking toe end closing apparatus, the improvement according to claim 6 and characterized further in that said spreading means is longitudinally reversibly movable from said spreading position after said insertion and spreading.

13. In a stocking toe end closing apparatus, the improvement according to claim 7 and characterized further in that said spreading means is longitudinally reversibly mobvable after said longitudinal removal and prior to subsequent expansion thereof at said spreading position.

14. In a stocking toe end closing apparatus, the improvement according to claim 7 and characterized further in that said position of said spreading means for locating the widespread toe end in said clamping means comprises a position beyond said clamping means.

15. In a stocking toe end closing apparatus, the improvement according to claim 6 and characterized further by a perforated suction plate located adjacent said clamping means and underneath said toe end extremity when said toe end is clamped in said clamping means for holding said toe end extremity down and away from said clamping means for direction and guidance into said seaming means.

16. In a stocking toe end closing apparatus having seaming means for closing toe ends of stockings; clamping means located for clamping a stocking toe end and moving it past said seaming means for closing; elongated stocking support means for supporting a stocking with an open toe end at a spreading position; movable expandable spreading means insertable into the open toe end of a stocking carried on the support means at the spreading position and expandable after insertion to support the open toe end and spread it laterally to a flat widespread width suitable for seaming; transfer means for causing sequential insertion movement of said spreading means into the toe end of a supported stocking, movement of said spreading means in relation to said clamping means to a position for locating the supported widespread toe end in said clamping means for clamping thereby with its extremity outside thereof, and return movement of said spreading means for subsequent insertion movement thereof; and means for expanding said sreading means after said insertion movement thereof within a stocking toe end and for contracting said spreading means to release the toe end of the stocking after it is clamped by said clamping means; the improvement comprising a perforated suction plate located adjacent said clamping means and underneath said toe end extremity when said toe end is clamped in said clamping means for holding said toe end extremity down and away from said clamping means for direction and guidance into said seaming means.

17. In a stocking toe end closing apparatus, the improvement according to claim 6 and characterized further (a) by said transfer means including said shifting means for also causing a longitudinal removal movement of said spreading means from said toe end after said clamping of said toe end;

(b) in that said shifting means comprises slide means mounted on said transfer means and carrying said spreading means for movements longitudinally of said stocking support means and supplemental to said spreading means movement for locating said toe end in said clamping means and for said return movement of said spreading means for subsequent insertion movement thereof and means for causing said supplemental movements to occur in suitable sequence;

(c) in that said means for causing said supplemental movements comprises at least one actuator for causing reciprocal movements between said slide means and said transfer means and control means for said actuator operating in timed relationship with said transfer means; and (d) by means for adjusting the extent of said reciprocal movement for suitably relating said longitudinal insertion movement to a selected insertion depth in said toe end for suitable location of said toe end relative to said clamping means when said toe end is clamped therein.

18. In a stocking toe end closing apparatus, the improvement according to claim 17 wherein said adjusting means comprises a stop for limiting the insertion extent of said reciprocal movement caused by said actuator.

* * * * *

UNITED STATES PATENT OFFICE

CERTIFICATE OF CORRECTION

Patent No. 4,133,277 Dated January 9, 1979

Inventor(s) Ronald L. Arthur et al

It is certified that error appears in the above-identified patent and that said Letters Patent are hereby corrected as shown below:

Column 5, line 17, delete "51" and insert therefor --5-1--. Column 8, line 14, after "then" insert --the--. Column 8, line 48, delete "space" and insert therefor --spacer--. Column 10, line 41, after "but" insert --at--. Column 12, lines 44 and 45, delete "improvemet" and insert therefor --improvement--. Column 13, line 18, delete "mobvable" and insert therefor --movable--.

Signed and Sealed this

*Eighteenth* Day of *March 1980*

[SEAL]

*Attest:*

SIDNEY A. DIAMOND

*Attesting Officer*

*Commissioner of Patents and Trademarks*